US005447410A

United States Patent [19]

Hast et al.

[11] Patent Number: 5,447,410

[45] Date of Patent: Sep. 5, 1995

[54] METHOD AND DEVICE FOR PLACING AND TRANSFERRING SHEET ITEMS

[76] Inventors: Michael Hast, Geranienstr.6a, D-8000 Munich 70; Kilian Englert, Kochelseeweg 9, D-8192 Geretsried, both of Germany

[21] Appl. No.: 141,895

[22] Filed: Oct. 22, 1993

Related U.S. Application Data

[63] Continuation of Ser. No. 764,426, Sep. 23, 1991, abandoned.

[30] Foreign Application Priority Data

Sep. 27, 1990 [DE] Germany ..... 40 30 643.7

[51] Int. Cl.[6] ..... B65G 57/08

[52] U.S. Cl. ..... 414/791.2; 414/907; 414/795.2

[58] Field of Search ..... 414/907, 795.2, 795.3, 414/791.2

[56] References Cited

U.S. PATENT DOCUMENTS

| | | | |
|---|---|---|---|
| 3,115,090 | 12/2963 | Elander . | |
| 3,450,275 | 6/1969 | Carlen | 414/795.3 |
| 3,861,537 | 1/1975 | Duchinsky | 414/795.2 |
| 3,895,566 | 7/1975 | Anikanov | 414/795.2 |
| 4,432,685 | 2/1984 | Stauber | 414/795.3 |
| 4,522,386 | 6/1985 | Brown et al. . | |
| 4,547,112 | 10/1985 | Steinhart | 414/907 |
| 4,886,265 | 12/1989 | Wetter | 414/907 |
| 4,953,845 | 9/1990 | Castiglioni | 414/907 |

FOREIGN PATENT DOCUMENTS

| | | | |
|---|---|---|---|
| 0153983 | 9/1985 | European Pat. Off. . | |
| 0167704 | 1/1986 | European Pat. Off. . | |
| 0181987 | 5/1986 | European Pat. Off. . | |
| 0234444 | 9/1987 | European Pat. Off. . | |
| 0309745 | 4/1989 | European Pat. Off. . | |
| 0348610 | 4/1989 | European Pat. Off. . | |
| 2615998 | 10/1976 | Germany | 414/791.2 |
| 2827540 | 11/1979 | Germany . | |
| 86066455 | 11/1986 | Germany . | |
| 3527902 | 2/1987 | Germany . | |
| 3205220 | 6/1991 | Japan | 414/907 |
| 2082548 | 3/1982 | United Kingdom . | |

*Primary Examiner*—Michael S. Huppert
*Assistant Examiner*—Gregory A. Morse
*Attorney, Agent, or Firm*—Palmatier, Sjoquist & Helget

[57] ABSTRACT

In a method and/or a device for placing and transferring sheet items folded at least once and featuring a stacking device for the delivered sheet items and a compression device and in which the sheet items are placed or stacked singly or bundled on a placement table, the resulting bundle is elevated with the placement table, locked in this position and compressed; the subsequent bundle produced in the same way is then combined with the already compressed bundle before the stack is finally lateral-transferred together with its holding device.

8 Claims, 5 Drawing Sheets

METHOD AND DEVICE FOR PLACING AND TRANSFERRING SHEET ITEMS

This is a continuation of 07/764,426, filed Sep. 23, 1991, now abandoned.

The invention relates primarily to a method for placing and transfering sheet items with a stacking device for the the delivered sheet items and a compression device, said sheet items being placed and bundled on a placement table, singly or bundled In a device of this kind according to German published patent 1 957 337 the delivery of the folded sheet items—which in this case are newspapers—is in bundles from the one end to the stack and then in the opposite direction from the other end to the stack. On completion of a bundle, e.g. of ten newspapers, the ends are reversed so that according to the stacking of the sheet items or existing bundles the height of the complete bundle or stack is reduced until the lowest position of the placement plate is attained for the stack. After this the stack is transferred laterally. Since no compression of the single bundles or folded sheet items is provided, the resulting stack is relatively high and there is a risk of the stack tilting when being conveyed further.

The object of the invention is to create a method of the aforementioned kind with which not only a dense or compact stack is achieved, but which also more or less eliminates the differences in height in each bundle or in the complete stack whilst avoiding tilting of the stack.

This object is achieved by the invention enabling the bundle or sheet item resulting from stacking and bundling to be conveyed upwards, locked in this position and compressed, the next bundle being produced in the same way and the new bundle(s) on the previous bundle being removed from the top until finally the stack is transferred laterally together with its holding fixture.

On the one hand it is possible to ensure further transfer of the single bundle or stack after compression prior to the end and, on the other hand, the resulting compressed stack is moved together with the holding device to the discharge point or for further transfer.

This method is particularly suitable when the individual bundles are placed criss-cross so that each fold is located at different ends. For this situation the invention proposes that each single bundle and/or stack is turned thru 90° or a multiple thereof following the elevation. It is good practice to place criss-crossing so that when two bundles are stacked, the corresponding folds are located opposite to each other. But it is also possible that four bundles form a stack, the folds then running along all four sides.

In one preferred embodiment of the method according to the invention the compression is maintained during the lateral transfer.

Stacking can be achieved particularly quickly in criss-cross placement when at least two similar holding devices are served by a transfer device and the next holding device is furnished following completion of the bundle or stack in the holding device.

A further object of the invention is to create a device for application of the aforementioned method.

This object is achieved by the invention providing above a placement table which may feature lateral guiders, a holding device featuring a gripper or supporting device and the like gripping under the bundle or stack in question and a compressing device acting on the bundle and/or stack. The holding device may consist of a plate and the like, the compression device located underneath and the gripper and supporting device running in the direction of the placement table; the gripper and supporting device may also comprise gripper and supporting bars and the like moving in opposing directions.

The compression device usefully comprises at least one compression plate which may be two-part; the latter usefully consisting of at least two parts which overlap and are spring-loaded.

The rotating device is preferably arranged above the holding device and the latter is free to turn without the placement table so that criss-cross placement of the individual sheet items or bundles thereof is achieved.

The turning device may have a ring gear type bearing.

The holding device is usfully provided with means for adjusting the spacing of the opposed gripper and supporting bars and the like, it thus not only being possible to provide lateral alignment of the bundle during placement of the individual sheet items to form the bundle by means of the alignment device, but also to provide lateral adjustment of the gripper and supporting device so that different sizes of the sheet items can be accommodated.

The turning device may feature a centrally arranged ring gear bearing and the like on the plate and the like, it also being possible to run the plate and the like on rails, a frame and the like for lateral transfer of the holding device.

The drawing shows the example of an embodiment in which as described in the following:

Figure 1:
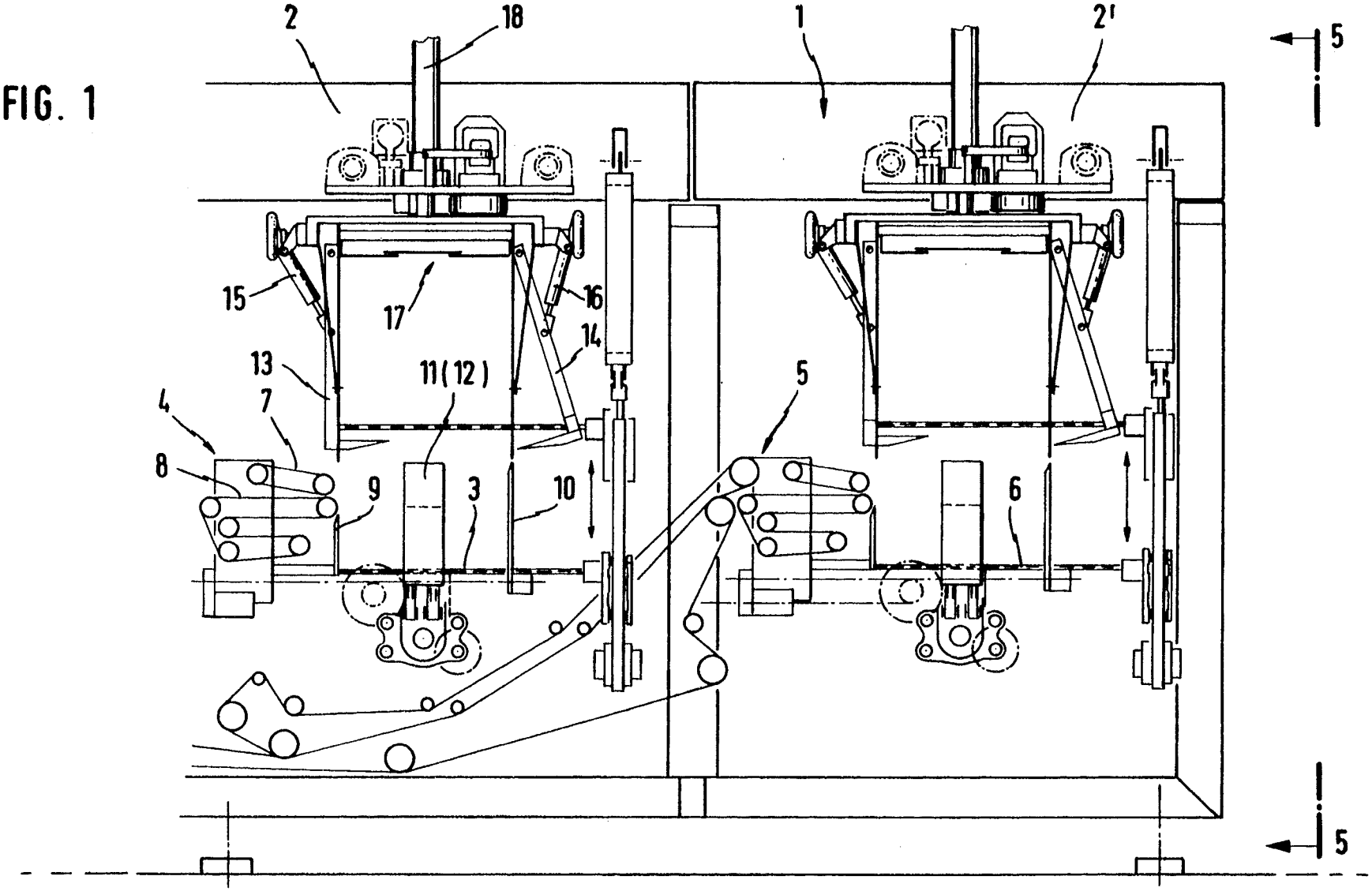
FIG. 1 is a side view of an embodiment having two holding devices.

By means of a frame 1 two holding devices 2 of the same design are maintained at the same level alongside each other. These holding devices 2 and/or 2' alternately receive the individual sheet items from two transfer devices. Following completion of a bundle on a placement table 3 by the transfer device 4, the procedure is then as described below. After this, conveyor system 5 delivers the individual sheet items to the placement table 6. This synchronized supply of the two holding devices 2,2' ensures delivery of the sheet items, e.g. shingled without interruption as determined by the compression procedure described in the following.

For the sake of simplicity, merely holding device 2 is detailed in the following, since—as already mentioned—holding device 2' is of the same design. Between the endless conveyor units 7 and 8 the shingled supply of folded sheet items is delivered. The placement table 3 is height-adjustable and is automatically lowered according to the supply of sheet items. At the opposite ends of placement table 3 aligners 9 and 10 are provided which ensure a bundle of the sheet items which is flush on all sides, the same purpose serving the opposing aligners 11. On completion of a bundle, e.g. of 10 paper products, the placement table 3 is elevated so that the gripper and-supporting bars 13, 14 can be located underneath the bundle. For this purpose the hydraulic cylinders 15 and 16 are provided.

A compression plate 17 described in more detail below is then lowered on to the bundle to press it together.

At the same time, the placement table has since been automatically lowered into a position (not shown), i.e. the receiving position so that a new supply of sheet items can be made via the conveyor belts 7,8 in the aforementioned manner.

Before the second bundle on placement table 3 has attained its topmost or maximum stacking height which is level with the top section of the conveyor belt 8, the holding device 3 is rotated thru 180° about its center point; the compressed bundle then presenting the folded edges at the opposite end. The gripper and supporting arms 13 and 14 are then swivelled outwardly so that the compressed bundle can be placed on the sheet items which have since been placed uncompressed. The two bundles are then elevated by lifting of the placement plate 3 under the gripper and supporting arms 13 and 14 so that the latter can again be swivelled inwardly. Compression plate 17 is then used for repeat compression of the two bundles.

This procedure is repeated until the maximum receiving capacity of the holding device 2 is attained, whereby the compression plate remains on the stack so that the complete holding device, as described in more detail below, can be laterally transferred together with the stack.

Figure 2:
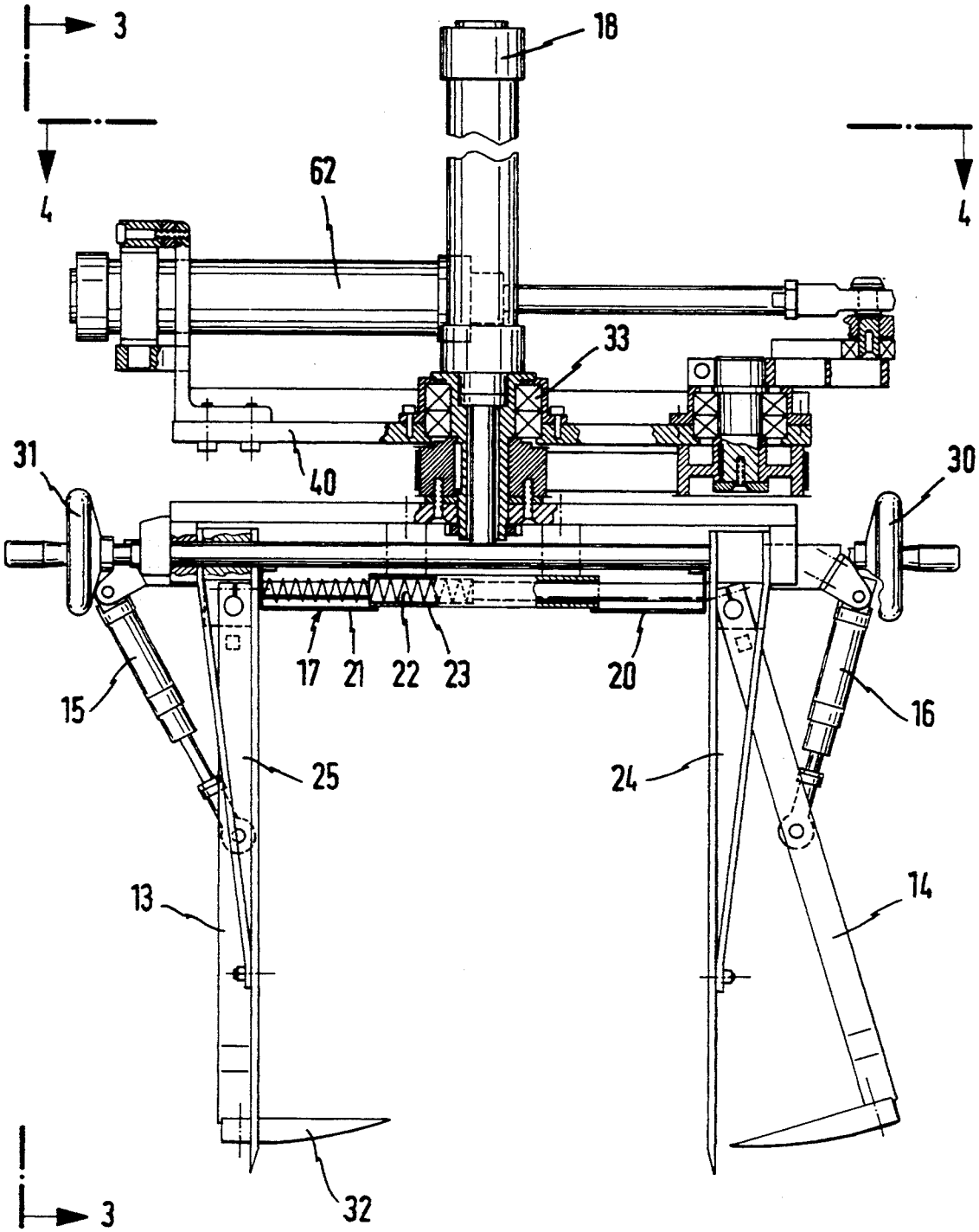
FIG. 2 is an enlarged view of a holding device.

The compression plate detailled in FIG. 2 comprises at least two, in this case, three parts, whereby the two outer parts 20 and 21 are fixed or connected to a frame structure. The center part 23 of the plate 17 is located free to shift with respect to the plates 20 and 21 and loaded by a spring 22, thus making it possible to change the distance of the two gripper and supporting bars 13 and 14 or their corresponding frame components 24 and 25 to adapt to the corresponding width or depth of the stack. Adjusting the spacing can be done by means of the supports 30 or 31.

Figure 3:
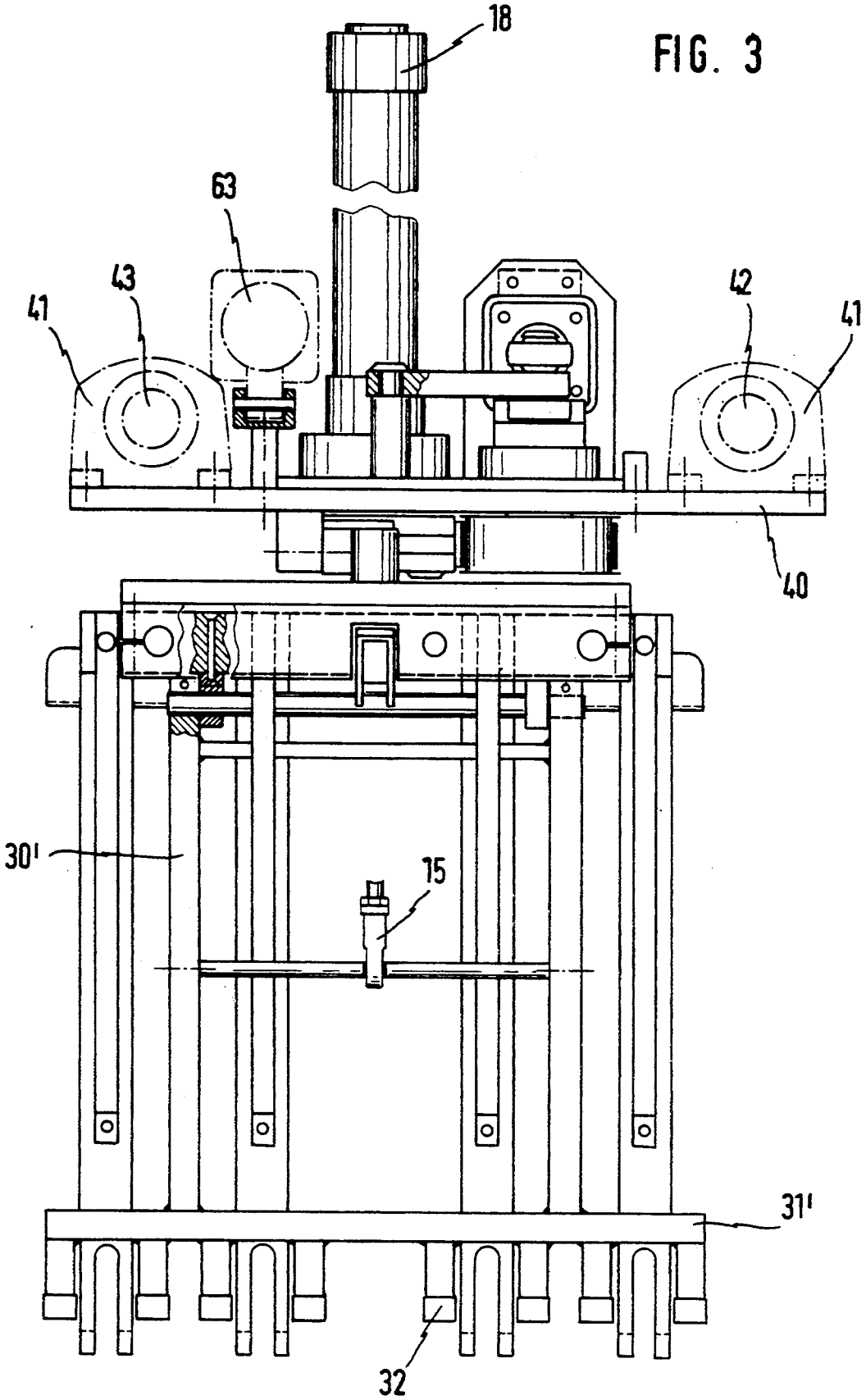
FIG. 3 is a view along line 3—3 in FIG. 2.
Figure 4:
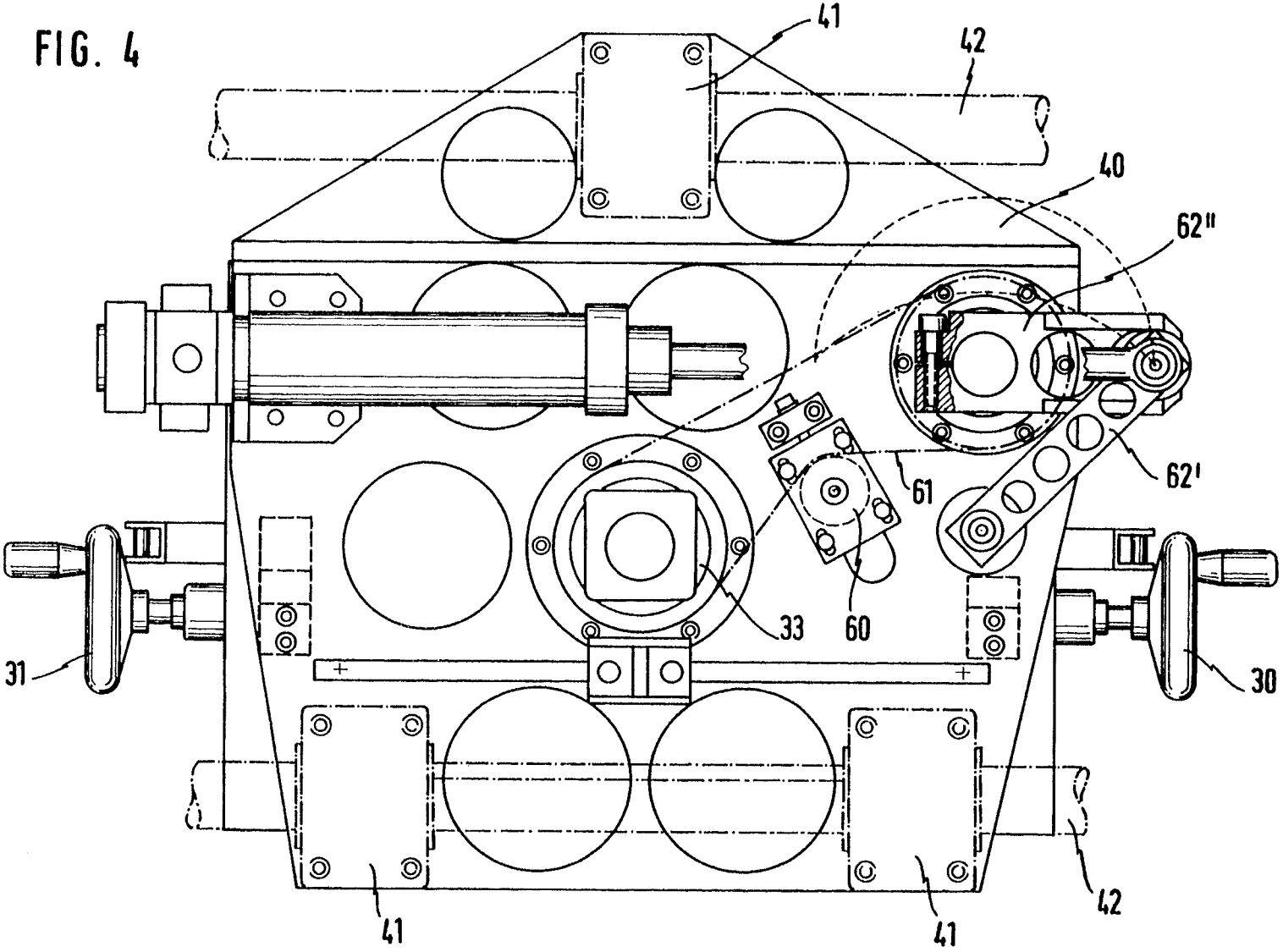
FIG. 4 is a plan view on the holding the device according to line 4—4 in FIG. 2

As evident from FIG. 3 the supporting and gripper device features a frame structure 30' on the cross bar 31' of which gripper teeth 32 are provided which in the swivelled-in position undergrip and hold the bundle or stack.

The aforementioned compression plate 17 comprising the parts 20–23 can be lowered between the supporting and gripper bars 13 and 14.

The holding device 2 with the gripper and supporting device and the compression plate is connected to a holding plate 40 via a ring gear 33 (FIG. 2). The holding plate features two holding fixtures 41 for two rails 42 on which the holding device can be transfered, as described further below.

Figure 5:
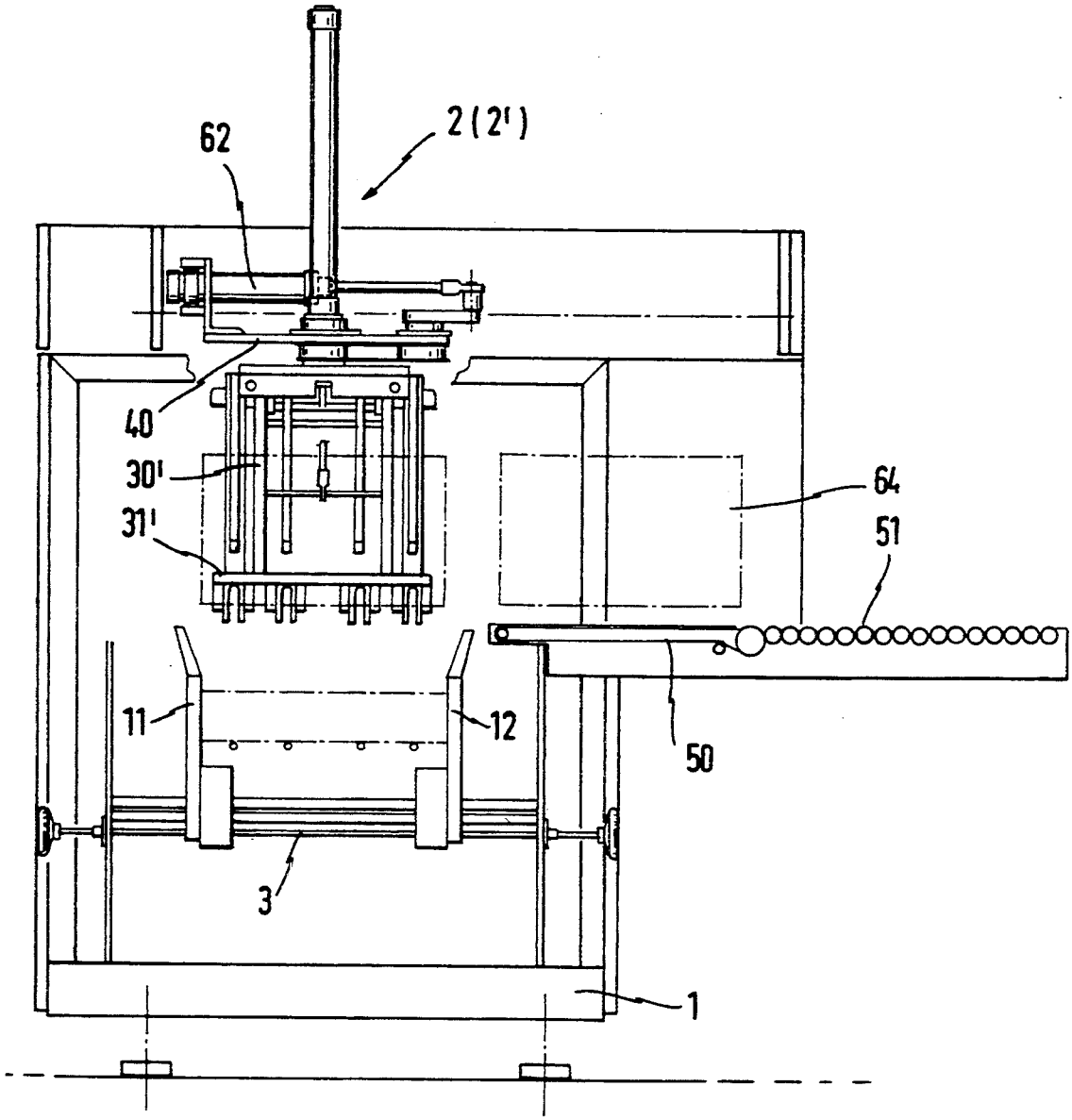
FIG. 5 is a side view of the complete system according to line 5—5 in FIG. 1.

As evident from FIG. 5 a placement table 50 having a roller conveyor 51 is provided alongside each holding device 2 or 2', the latter being transfered together with the stack held compressed in the support over the holding table 50. In this position the supporting or gripper bars are swivelled back so that the compressed stack can be placed and forwarded to further handling. Rotation of the holding device or the support can, as already mentioned, be thru 90° or—as is generally preferred—thru 180°. For rotation a hydraulic cylinder 62 is provided.

Via a steering element 62' which is guided by a link 62'' and via a belt 61 the hydraulic cylinder 62—see FIG. 5—turns the ring gear 33 and thus the complete holding device 2.

Shifting the complete holding device 2 on the rails 42, 43 is done by an hydraulic cylinder 63 (not shown in FIG. 5, but indicated in FIG. 3).

What is claimed is:

1. A device for receiving, bundling and stacking sheet items, comprising a placement table having an area for receiving sheet items to form a bundle and a stack of bundles; a vertically-movable compression plate mounted above said placement table area, means for raising and lowering said compression plate; a holding device below said compression plate, having means for holding at least one bundle and means for gripping beneath the lowest bundle; means for elevating said placement table to engage said gripping means beneath said bundle formed on said placement table; whereby said bundle may be compressed between said compression plate and said gripping means subsequently to said engagement of said gripping means with said bundle; and means for laterally moving said holding device and said stack of bundles away from said area.

2. The device of claim 1, wherein said holding device further comprises a plate.

3. The device of claim 1, wherein said gripping means further comprises a plurality of L-shaped gripper and supporting bars having gripper teeth for supporting the bottom side of said at least one bundle.

4. The device claim 1, wherein said compression plate further comprises at least two overlapping parts.

5. The device of claim 1, further comprising means for rotating said holding device in the horizontal plane.

6. The device of claim 5, wherein said means for laterally moving said holding device and said at least one bundle further comprises lateral rails and means for guiding said holding device along said rails.

7. The device according to claim 5, wherein said means for rotating further comprises means for rotating said holding device in the horizontal plane at least through 90°.

8. The device according to claim 5, wherein said means for rotating further comprises means for rotating said holding device in the horizontal plane through 180°.

* * * * *